US007824018B2

(12) United States Patent
Shida

(10) Patent No.: US 7,824,018 B2
(45) Date of Patent: Nov. 2, 2010

(54) IMAGE FORMING APPARATUS, MARKET SUPPORT SYSTEM, CONTROL METHOD AND PROGRAM

(75) Inventor: Masanori Shida, Abiko (JP)

(73) Assignee: Canon Kabushiki Kaisha (JP)

( * ) Notice: Subject to any disclaimer, the term of this patent is extended or adjusted under 35 U.S.C. 154(b) by 365 days.

(21) Appl. No.: 12/055,003

(22) Filed: Mar. 25, 2008

(65) Prior Publication Data

US 2008/0240765 A1 Oct. 2, 2008

(30) Foreign Application Priority Data

Mar. 26, 2007 (JP) ..... 2007-079219

(51) Int. Cl.
*B41J 2/045* (2006.01)

(52) U.S. Cl. ..... 347/71

(58) Field of Classification Search ..... 347/171–173, 347/175–176, 183, 184, 186, 198, 213, 215, 347/218, 5, 14; 400/120.01, 120.02, 120.04, 400/120.14, 120.16
See application file for complete search history.

(56) References Cited

U.S. PATENT DOCUMENTS 6,494,629 B2 * 12/2002 Hayashi et al. ..... 400/120.14
6,664,994 B2 * 12/2003 Kyogoku et al. ..... 347/215
7,042,479 B2 * 5/2006 Furuki et al. ..... 347/183

FOREIGN PATENT DOCUMENTS

JP 2003-215865 A 7/2003

* cited by examiner

*Primary Examiner*—K. Feggins
(74) *Attorney, Agent, or Firm*—Rossi, Kimms & McDowell LLP

(57) ABSTRACT

An image forming apparatus for reducing time required for adjusting the image forming conditions and transport conditions and minimizing the number of recording material used for the adjustment. Image forming conditions and transport conditions for the recording material are adjusted according to the characteristic properties of the recording material. Associated data including an adjustment value obtained from the adjustment of the image forming conditions and transport conditions made by the adjustment unit and the characteristic properties of the recording material associated with the adjustment value is generated. The associated data stored in the storage unit is transmitted to the data collection/delivery apparatus. Delivery data regarding the adjustment of the image forming conditions and transport conditions is received from the data collection/delivery apparatus.

14 Claims, 11 Drawing Sheets

IMAGE FORMING APPARATUS, MARKET SUPPORT SYSTEM, CONTROL METHOD AND PROGRAM

BACKGROUND OF THE INVENTION

1. Field of the Invention

The present invention relates to an image forming apparatus that transfers an image formed on an image carrier onto recording paper (recording material), a market support system, a control method and a program.

2. Description of the Related Art

In recent years, an expanding marketplace has led to an increasing demand on image forming apparatuses, which performs electrophotographic image formation in multiple colors (including in full color), for forming images on various kinds of recording paper. However, manufacturers of image forming apparatuses do not individually set the image forming conditions (transferring conditions, fixing conditions, etc.) and recording-paper transport conditions (hereinafter abbreviated to "transport conditions") for every kind of recording paper used in the marketplace.

Most users set the image forming conditions and transport conditions to the most versatile values based on the recording paper that is recommended by the manufacturer of the image forming apparatus as a typical kind of paper. Consequently, the image forming conditions and transport conditions of the conventional image forming apparatuses are not set according to each kind of recording paper, according to images and contrast of user's preference, or according to the usage environment of the image forming apparatuses.

In order to solve the above problem, some methods of setting each image forming apparatus for the image forming conditions and transport conditions for recording paper have been proposed (see Japanese Laid-Open Patent Publication (Kokai) No. 2003-215865).

The image forming apparatus proposed in Japanese Laid-Open Patent Publication (Kokai) No. 2003-215865 has a function of rewriting values preset by the manufacturer to values suitable for the usage of the image forming engine and user's preference; however, detailed settings of the image forming conditions and transport conditions cannot be made for increasingly diverse kinds of recording paper. Upon setting the image forming conditions and transport conditions for recording paper, the setting value of a basis weight (a weight of paper per unit area)/surface properties (the degree of smoothness or roughness of the paper surface)/resistance and so on may be different depending on the kind of the recording paper. Furthermore, the user's preference in image quality (print condition of the image) to the base of the recording paper may not always be the same.

In addition, the image forming apparatus proposed in Japanese Laid-Open Patent Publication (Kokai) No. 2003-215865 can changes/stores the settings depending on the kind of recording paper, or changes the settings of the image forming apparatus according to the user's preference. However, if the user prefers to change the setting accompanied with a change in the kind of recording paper used in the image forming apparatus, the user is required to reset the settings. This requires the user to perform troublesome and cumbersome work.

In order to solve the above-mentioned problem, it is desirable to set in detail and store the image forming conditions and transport conditions including the media type, basis weight, surface properties, thickness, resistance and so on of the recording paper. Furthermore, it is desirable to read out a setting by using the parameters including the media type, basis weight, surface properties, thickness, resistance and so on as keywords.

In addition, a user visually checks an output image to adjust the image forming conditions and transport conditions according to the kind of recording paper. However, the user needs to change several items of the image forming conditions and transport conditions to make the adjustment, thus it takes time for the users to finish all the adjustment. Furthermore, it requires a lot of recording papers for outputting images to adjust all the conditions, which is a waste of the recording paper.

SUMMARY OF THE INVENTION

The present invention provides an image forming apparatus for reducing time required for adjusting the image forming conditions and transport conditions and minimizing the number of recording material used for the adjustment, a market support system, a control method and a program.

In a first aspect of the present invention, there is provided an image forming apparatus configured to transfer an image formed on an image carrier onto a transported recording material to perform image formation and adapted to communicate with a data collection/delivery apparatus, comprising an adjustment unit adapted to adjust image forming conditions and transport conditions for the recording material according to the characteristic properties of the recording material, a generation unit adapted to generate associated data including an adjustment value obtained from the adjustment of the image forming conditions and transport conditions made by the adjustment unit and the characteristic properties of the recording material associated with the adjustment value, a storage unit adapted to store the associated data, and a control unit adapted to transmit the associated data stored in the storage unit to the data collection/delivery apparatus and receive delivery data regarding the adjustment of the image forming conditions and transport conditions from the data collection/delivery apparatus.

According to the present invention, the image forming apparatus transmits associated data including an adjustment value associated with characteristic properties of the recording material to the data collection/delivery apparatus, and receives delivery data concerning the adjustment of the image forming conditions and transport conditions from the data collection/delivery apparatus. In this manner, reduction of time required to adjust the image forming conditions and transport conditions and minimization of the amount of recording material used for the adjustment can be realized.

In a second aspect of the present invention, there is provided a market support system comprising the image forming apparatus and the data collection/delivery apparatus according to claim 1, the image forming apparatus and data collection/delivery apparatus being connected through a network to communicate with each other, wherein the data collection/delivery apparatus is connected to other image forming apparatuses including the adjustment unit, the generation unit, the storage unit and the control unit through the network to communicate with each other, and the data collection/delivery apparatus includes a collection unit adapted to collect the associated data from the image forming apparatus and the other image forming apparatuses and a delivery unit adapted to deliver the delivery data through the network to the image forming apparatus and the other image forming apparatuses.

In a third aspect of the present invention, there is provided a control method of an image forming apparatus configured to transfer an image formed on an image carrier onto a transported recording material to perform image formation and adapted to communicate with a data collection/delivery apparatus, the method comprising steps of adjusting image forming conditions and transport conditions for the recording material according to the characteristic properties of the recording material, generating associated data including an adjustment value obtained through the adjusting step of adjusting the image forming conditions and transport conditions and the characteristic properties of the recording material associated with the adjustment value, storing the associated data in a storage unit, and transmitting the associated data stored in the storage step to the data collection/delivery apparatus and receiving delivery data regarding the adjustment of the image forming conditions and transport conditions from the data collection/delivery apparatus.

In a fourth aspect of the present invention, there is provided a program configured to cause a computer to execute a control method of an image forming apparatus configured to transfer an image formed on an image carrier onto a transported recording material to perform image formation and adapted to communicate with a data collection/delivery apparatus, wherein the control method comprises the steps of adjusting image forming conditions and transport conditions for the recording material according to the characteristic properties of the recording material, generating associated data including an adjustment value obtained through the adjusting step of adjusting the image forming conditions and transport conditions and the characteristic properties of the recording material associated with the adjustment value, storing the associated data in a storage unit, and transmitting the associated data stored in the storage step to the data collection/delivery apparatus and receiving delivery data regarding the adjustment of the image forming conditions and transport conditions from the data collection/delivery apparatus.

The above and other objects, features, and advantages of the invention will become more apparent from the following detailed description taken in conjunction with the accompanying drawings.

DESCRIPTION OF THE EMBODIMENTS

The present invention will now be described in detail with reference to the drawings showing preferred embodiments thereof. It should be noted that the relative arrangement of the components, the numerical expressions and numerical values set forth in these embodiments do not limit the scope of the present invention unless it is specifically stated otherwise.

Figure 1:
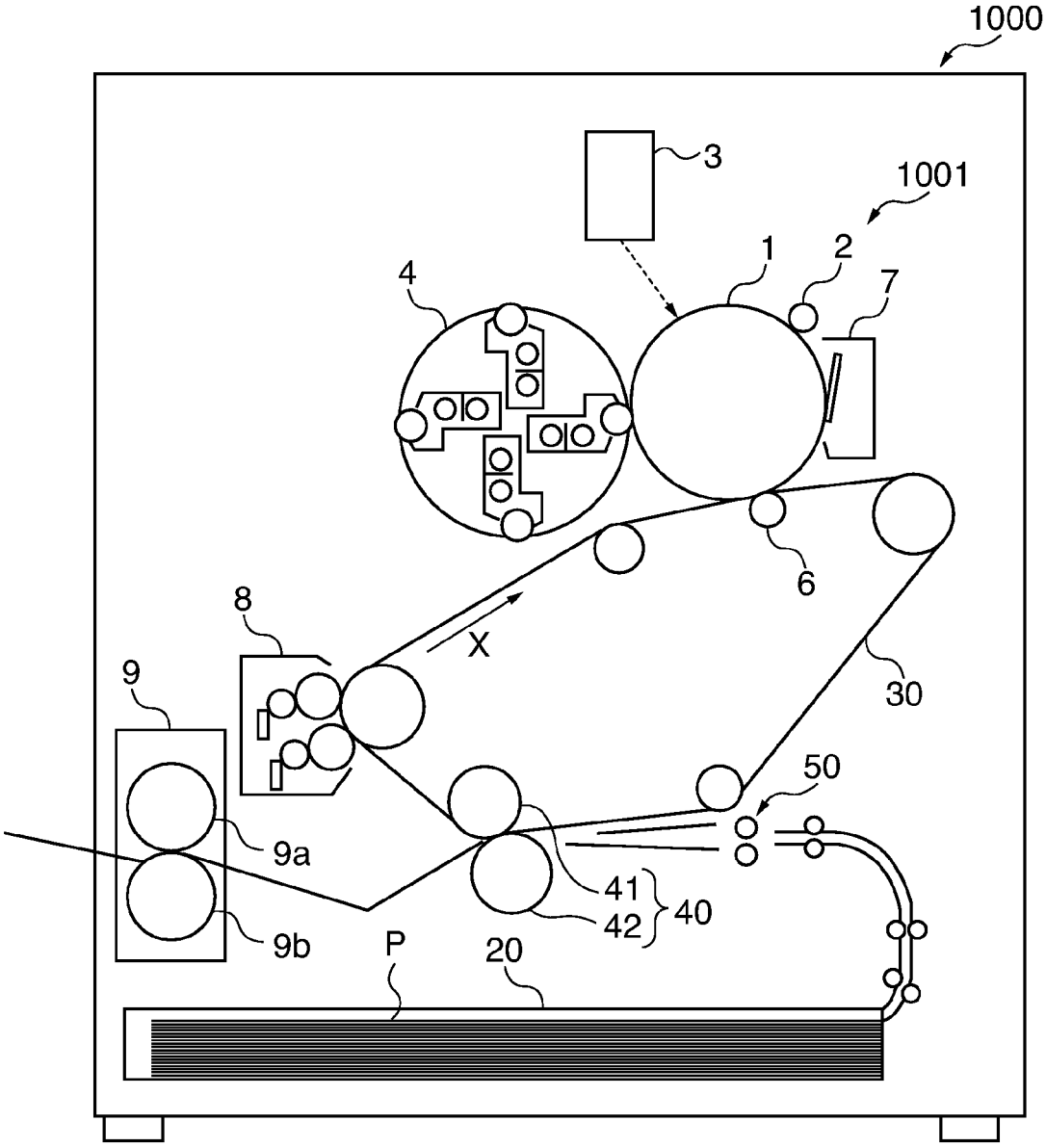
FIG. 1 is a diagram showing a schematic configuration of an image forming apparatus according to an embodiment of the present invention.
Figure 2:
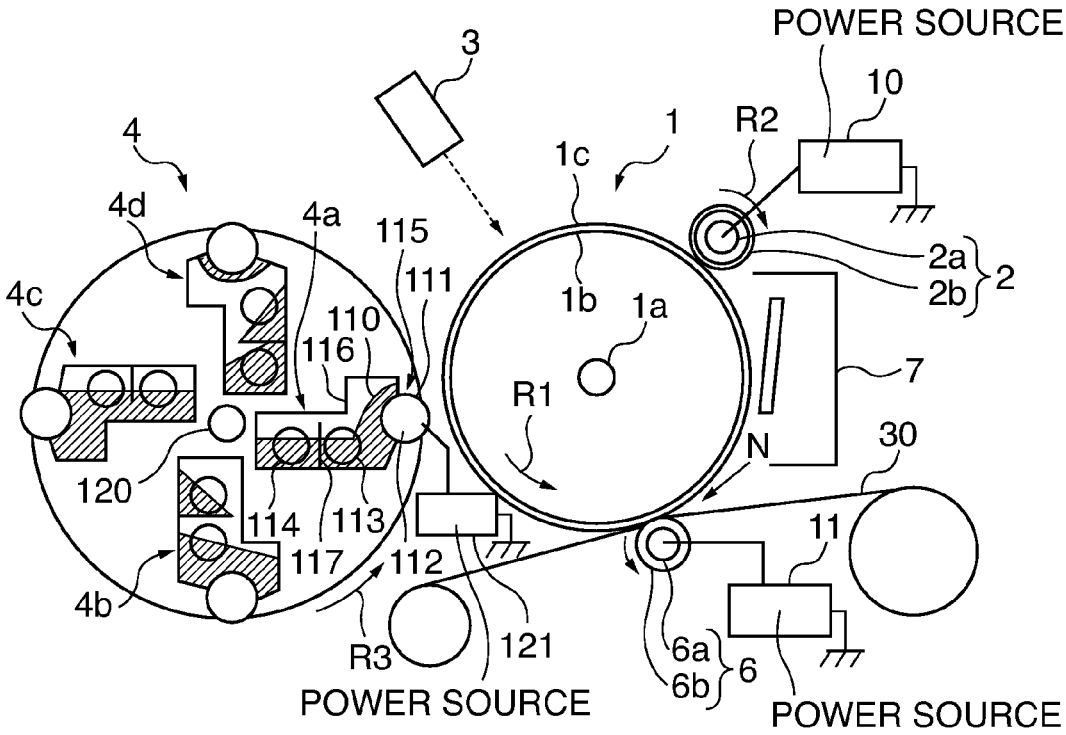
FIG. 2 is a diagram showing a configuration of an image forming unit of the image forming apparatus in FIG. 1.

FIG. 1 is a diagram showing a schematic configuration of an image forming apparatus according to an embodiment of the present invention. FIG. 2 is a diagram showing a configuration of an image forming unit of the image forming apparatus in FIG. 1.

In FIGS. 1 and 2, the image forming apparatus 1000 comprises a drum-like electrophotographic photoreceptor (hereinafter, referred to as "photoconductive drum") 1, a developing unit 4, a roller-like transfer unit (hereinafter, referred to as "transfer roller") 6, a fixing unit 9, an intermediate transfer member 30, a secondary transfer unit 40 and other components, and performs electrophotographic image formation. In addition, the image forming apparatus 1000 can communicate with a data collection/delivery apparatus 95 (see FIG. 9) which will be described later.

The photoconductive drum 1 is a cylindrical-shaped image carrier on which an electrostatic latent image is formed by irradiation of laser beams from an exposure unit 3, and constitutes an image forming unit 1001. The photoconductive drum 1 comprises a shaft 1*a*, a conductive substrate 1*b* made of aluminum or the like and a photoconductive layer 1*c* formed around the outer circumference of the conductive substrate 1*b* and is driven by a drive mechanism (not shown) to rotate around the shaft 1*a* in the direction of arrow R1. Process mechanisms including a primary charger (hereinafter, referred to as "charge roller") 2, the developing unit 4 and other components are arranged around the photoconductive drum 1. Reference numeral 7 in FIG. 2 denotes a cleaner to remove residual toner on the photoconductive drum 1.

The charge roller 2 touches the surface of the photoconductive drum to uniformly and evenly charge the surface so as to have a specified polarity and potential. As shown in FIG. 2, the charge roller 2 is comprised of a conductive roller (core metal) 2*a* disposed in the center of the charge roller 2 and a conductive layer 2*b* formed around the outer circumference of the conductive roller 2*a*. The opposite ends of the core metal 2*a* are supported by a bearing member (not shown) so that the charge roller 2 can rotate freely and is disposed parallel to the photoconductive drum 1. The bearing member supporting the opposite ends of the core metal 2*a* are biased toward the photoconductive drum 1 by a pressure mechanism (not shown), and therefore the charge roller 2 is pressed against the surface of the photoconductive drum 1 at a specified pressure.

The charge roller 2 is rotated in the direction of arrow R2 in conjunction with rotation of the photoconductive drum 1 in the direction of arrow R1. The core metal 2*a* of the charge roller 2 is in contact with an electrical contact connected to a power source 10. The charge roller 2 uniformly and evenly charges the surface of the photoconductive drum 1 with a bias voltage applied from the power source 10.

The developing unit 4 is disposed on the downstream side of the exposure unit 3, comprises developing devices 4*a*, 4*b*, 4*c*, and 4*d* and develops electrostatic latent images formed on the surface of the photoconductive drum 1. The developing unit 4 rotates around a rotary shaft 120 in the direction of arrow R3 by 45° at one time to shift the developing devices 4*a*, 4*b*, 4*c* and 4*d* in the mentioned order to a position opposite to the photoconductive drum 1. Through this operation, toner images are successively formed on the electrostatic latent image formed on the surface of the photoconductive drum 1.

Now, a description will be made about the configuration of the developing device 4*a* below. The other developing devices 4*b* to 4*d* will be described later. The developing device 4*a* has a developer container 116 containing two-component developer (hereinafter simply referred to as "developer") 110. In an opening, which faces the photoconductive drum 1, of the developer container 116, a development sleeve 111 is rotatably disposed. A magnet roller 112 causing the development sleeve 111 to carry the developer is fixedly disposed so as not to rotate with the rotation of the development sleeve 111.

Above the development sleeve 111 of the developer container 116, a control blade 115 that controls the developer carried on the development sleeve 111 to form a thin developer layer is disposed perpendicular to the development sleeve 111. In addition, there are a developing room 113 and an agitation room 114, which are partitioned by a wall 117, in the rough lower half of the developer container 116. The developer 110 is mainly composed of toner and magnetic carriers. The toner is negatively charged, while the carriers are positively charged.

First, as the development sleeve 111 rotates, the developer 110 in the developing room 113 is drawn up by the magnetic pole of the magnet roller 112 and carried on the development sleeve 111. The drawn up developer 110 is transferred with the rotation of the magnet roller 112 and the toner is negatively charged in the course of the transfer process. The developer 110 is controlled by the control blade 115. In this manner, the developer 110 is formed a thin developer layer.

When the developer 110 forming the thin developer layer is transferred to a developing area opposite the photoconductive drum 1, the developer 110 stands up in bristle-like formations caused by the action of the magnetic force of the developing main pole positioned in the developing area of the magnet roller 112 and a magnetic brush of the developer 110 is formed. While the magnetic brush of the developer 110 is run over the surface of the photoconductive drum 1, a bias power source 121 applies a development bias voltage to the development sleeve 111. Thus, the toner adhering to the carriers that make up the bristles of the magnetic brush adheres to the visible parts of the electrostatic latent image (the parts exposed to the laser beam) and is developed to form a toner image (visible image) on the surface of the photoconductive drum 1.

An intermediate transfer member 30 is disposed under the photoconductive drum 1. The intermediate transfer member 30 is an image carrier comprised of an endless belt that is driven by a driving mechanism (not shown) to circulate in the direction of arrow X in FIG. 1. The intermediate transfer member 30 is made of dielectric resin (polycarbonate, polyethylene terephthalate resin film, polyvinylidene-fluoride resin film, polyimide, ethylene tetrafluoroethylene copolymer, and etc.). The intermediate transfer member 30 can be made of other materials and its volume resistivity and thickness can be arbitrarily selected. In addition, the surface layer of the intermediate transfer member 30 can be elastic. Reference numeral 8 in FIG. 1 denotes a cleaner that removes residual toner on the intermediate transfer member 30.

A transfer roller 6 is disposed under the photoconductive drum 1. The transfer roller 6, as shown in FIG. 2, is comprised of a conductive roller shaft 6*a* connected to a power source 11 and a conductive layer 6*b* that is a cylinder formed around the outer circumference of the conductive roller shaft Ga. It is desirable for the conductive layer 6*b* to have a resistance value of approximately 105 to 108 Ω·cm and to be made of EPDM, SBR, BR or the like with a closed-cell or open-cell structure. The transfer roller 6 is biased toward the photoconductive drum 1 by a pressing member having springs at opposite ends or the like (not shown). Accordingly, the conductive layer 6*b* is pressed at a specified pressing force and comes into contact with the photoconductive drum so as to sandwich the intermediate transfer member 30, thereby forming a transferring nip portion N.

The other developing devices 4*b*, 4*c* and 4*d*, which make up the developing unit 4, have the same configuration as the above-described developing device 4*a*. The developing devices 4*a*, 4*b*, 4*c*, and 4*d* are different in that each of them forms a toner image in yellow, magenta, cyan and black, respectively. The developing devices 4*a*, 4*b*, 4*c* and 4*d* contain yellow toner, magenta toner, cyan toner and black toner, respectively.

The image forming apparatus 1000 performs image formation as follows. First, the exposure unit 3 applies a laser beam corresponding to an image signal representative of yellow component color of an original image through an optical system including a polygonal mirror (not shown) to the photoconductive drum 1 in order to form an electrostatic latent image. Yellow toner is supplied to the photoconductive drum 1 from the developing device 4*a*, thereby making the electrostatic latent image into a yellow toner image. When the yellow toner image reaches the transferring nip portion N with a rotation of the photoconductive drum 1, the yellow toner image is transferred to the intermediate transfer member 30 by a transfer bias applied from the power source 11 to transfer roller 6.

By the time the yellow toner image carried on the intermediate transfer member 30 is transferred back to the transferring nip portion N after a rotation, the developing unit 4 rotates around the rotary shaft 120 in the direction of arrow R3 at 45 degrees to shift the developing device 4*b* to the position opposite the photoconductive drum 1. Accordingly, a magenta toner image formed on the surface of the photoconductive drum 1 is superimposed on the yellow toner image on the intermediate transfer member in the same method as above. Similarly, a cyan toner image and black toner image formed on the surface of the photoconductive drum 1 are superimposed on the yellow toner image and magenta toner image on the intermediate transfer member.

On the other hand, recording paper (recording material) P taken out from a paper feed cassette 20 is held by a pair of resist rollers 50, which feeds paper to a secondary transfer unit 40, and waits. When the toner image transferred onto the intermediate transfer member 30 comes to a specified position with the rotation of the intermediate transfer member 30, the pair of resist rollers 50 feeds the recording paper P to the secondary transfer unit 40. The four-color toner image (visible image) is transferred onto the recording paper P by applying a transfer bias to the secondary transfer unit 40. The secondary transfer unit 40 will be described in detail later by referring to FIG. 3.

The pair of resist rollers 50 needs to have the function of sending recording paper P to the secondary transfer unit 40 at a specified rate. Specifically, the pair of resist rollers 50 is comprised of a lower roller made of a material such as SUS and an upper roller made of a material such as POM. The pair of resist rollers 50 is biased by a pressing member such as a spring (not shown), nips the recording paper P and rotates to transport it. The recording-paper transport rate of the pair of resist rollers 50 is higher by approximately 0.3% than the recording-paper transport rate of the secondary transfer unit 40.

In addition to the above-described image forming unit 1001, the image forming apparatus 1000 comprises a controller, a display, an apparatus interface and other components. The configuration of each of these components will be described by referring to FIGS. 9 and 10.

Figure 3:
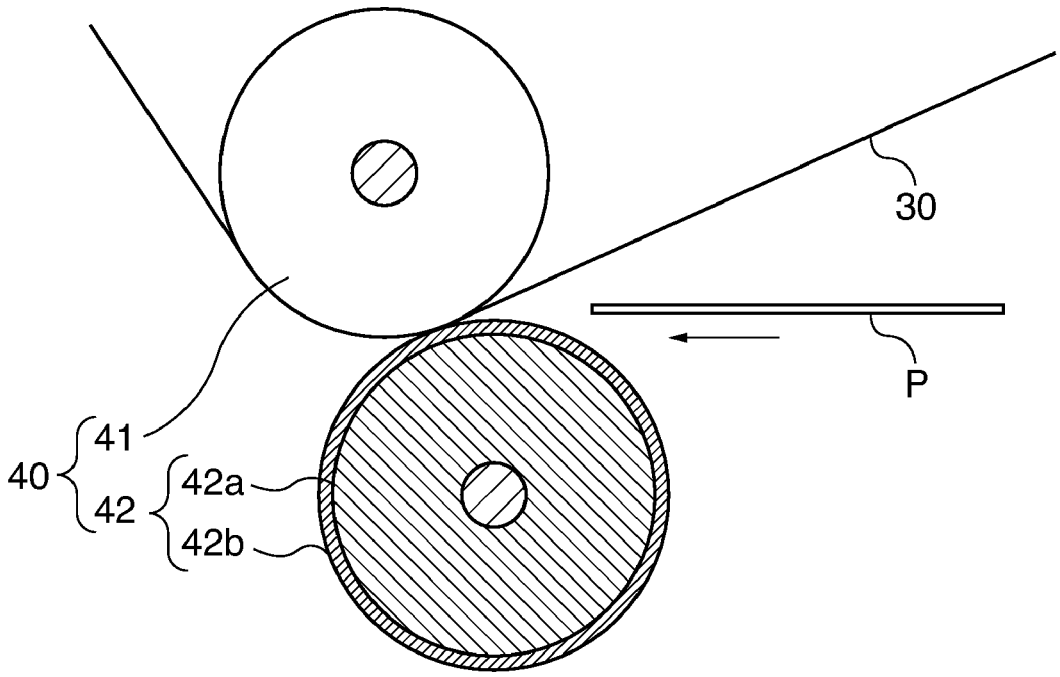
FIG. 3 is a diagram showing a configuration of a secondary transfer unit of the image forming apparatus.

FIG. 3 is a diagram showing a configuration of the secondary transfer unit 40 of the image forming apparatus 1000.

In FIG. 3, the secondary transfer unit 40 is comprised of a secondary transfer inner roller 41 positioned inside the intermediate transfer member 30 and a secondary transfer outer roller 42 positioned outside the intermediate transfer member 30. The secondary transfer outer roller 42 is comprised of a conductive shaft 42*a* of 24 mm in diameter and a conductive layer 42*b* covering the surface of the conductive shaft 42*a*. It is desirable for the conductive layer 42*b* of the secondary transfer outer roller 42 to have a resistance value of approximately 105 to 107 Ω·cm and to be made of solid or formable resin such as EPDM, SBR or BR, or to be made of a foam layer having a coat layer thereon.

By applying a transfer bias to either one of the secondary transfer inner roller 41 and secondary transfer outer roller 42 of the secondary transfer unit 40, the toner image on the intermediate transfer member is transferred onto the recording paper P passing through the secondary transfer unit 40. In this embodiment, the negatively charged toner image is transferred from the intermediate transfer member to the recording paper P by applying a positive bias to the secondary transfer outer roller 42. Subsequently, the recording paper P is transported by a transport mechanism to a fixing unit 9 including a pair of rollers 9*a* and 9*b* in which the toner image on the recording paper P is fixed, as shown in FIG. 1.

Next, a description will be made about an adjustment and record of image forming conditions and transport conditions according to the kind of recording paper for the image forming apparatus having the above configuration in the embodiment.

The image forming conditions and transport conditions of conventional image forming apparatuses are not set to meet various kinds of recording paper, the image and contrast of user's preference and the usage environment of the image forming apparatus. This embodiment is made to solve the conventional problem as described in detail below.

As to the setting control for image forming conditions of the present invention, transfer conditions, which is one of the image forming conditions, will be described. The transfer conditions is used for setting a transfer bias (transfer voltage, transfer current). Generally, the transfer conditions according to the kind of recording paper are roughly classified by the kind of the recording paper (media type: plain paper, recycled paper, heavy paper, special paper, and etc.) and the basis weight of the recording paper. However, the appropriate setting value of the transfer bias varies with the recording paper sheets even if the recording paper sheets are the same in type (e.g., heavy paper) and have the same basis weight because of their characteristic properties. The usage environment and the storage environment of the recording paper still vary the appropriate setting value of the transfer bias. The characteristic properties of the recording paper are selected from a group consisting a kind (media type) of the recording paper, the surface property indicating the degree of smoothness/roughness of the surface of the recording paper, the thickness of the recording paper, the resistance of the recording paper, the stiffness of the recording paper, and the moisture content of the recording paper.

The transfer conditions are set in the same manner as in the setting of the transfer conditions. In the fixing process of fixing the toner image on the recording paper, the setting of a fixing pressure, fixing temperature, fixing rate is needed to be changed. In this embodiment, the transfer conditions will be described below as one of the image forming conditions; however, it is needless to say that the present invention is not limited to the transfer conditions, but can be applied to the fixing conditions.

Among the transport conditions of recording paper, a description will be made about a rate of transporting the recording paper to a transferring position. To transport recording paper to the secondary transfer unit 40 by the pair of resist rollers 50, the default settings of the recording-paper transport rate of the pair of resist rollers 50 and the secondary transfer unit 40 generally establish the following relationship: the recording-paper transport rate of the pair of resist rollers 50>the recording-paper transport rate of the secondary transfer unit 40. This is because there is a need to prevent improper image formation caused by a tug at the recording paper between the pair of resist rollers 50 and secondary transfer unit 40, and further to prevent splattering phenomena of the toner image caused by a gap discharge between the recording paper and intermediate transfer member 30.

However, the thickness and surface properties of the recording paper vary the recording-paper transport rate provided by the rotation of the pair of resist rollers 50, thereby sometimes altering the relationship between the recording-paper transport rate of the pair of resist rollers 50 and the recording-paper transport rate of the secondary transfer unit 40. To deal with this problem, the rotation speed or the like of the pair of resist rollers 50 is changed to adjust the transport rate of the recording paper from the pair of resist rollers 50. In this manner, the transport rate of the recording paper from the pair of resist rollers 50 can be adjusted to handle the change of the characteristic properties (such as thickness, and surface properties) of the recording paper.

The need for the adjustment of the transfer conditions and transport conditions according to the kind of recording paper is appreciated from the above reasons. The adjustment of the transfer conditions is made by: preparing an adjustment chart (see FIG. 4); outputting the image of the adjustment chart on a plurality of recording paper sheets in different transfer conditions; and selecting the optimum image among the output images. The adjustment of the transport conditions is made by changing the rotation rate of the pair of resist rollers 50 as described above. After the adjustment of the transfer conditions and transport conditions, an adjustment value can be obtained (see FIG. 5). The adjustment value corresponds to a transfer voltage and transfer current in the transfer conditions, while corresponding to a recording-paper transport rate in the transport conditions.

The embodiment has the following characteristics.

The image forming apparatus 1000, which performs image formation by transferring an image formed on the intermediate transfer member 30 (image carrier) onto transported recording paper and can communicate with a data collection/delivery apparatus 95 in a service center, has a controller (see FIG. 9) that performs the following controls: adjusting image forming conditions and transport conditions according to the characteristic properties of the recording paper; storing data, including an adjustment value obtained from the adjustment of the image forming conditions and transport conditions and the characteristic properties of the recording paper associated with the adjustment value, in RAM; transmitting the data, including the adjustment value associated with the characteristic properties of the recording material, stored in the RAM to the data collection/delivery apparatus 95 and receiving delivery data, regarding the adjustment of the image forming conditions and transport conditions, from the data collection/delivery apparatus 95; and readjusting, if needed, the image forming conditions and transport conditions based on a plurality of images formed on the recording paper in different image forming conditions and transport conditions.

Figure 4:
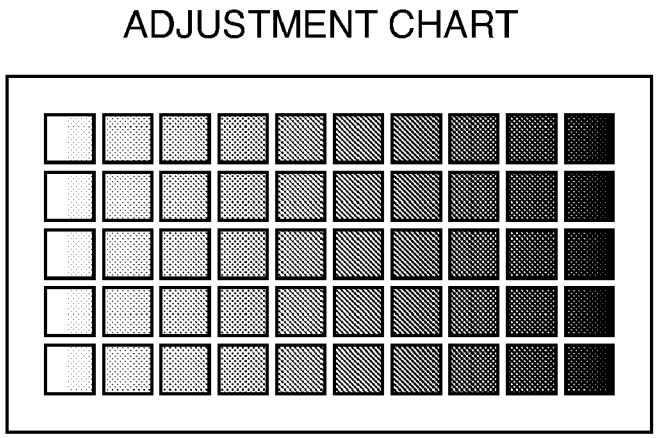
FIG. 4 is a diagram exemplifying an adjustment chart output by the image forming apparatus.

FIG. 4 is a diagram exemplifying an adjustment chart output by the image forming apparatus 1000.

In FIG. 4, the pattern of the adjustment chart is stored in ROM (see FIG. 10) of the image forming apparatus 1000 and can be output as an image formed on recording paper by the image forming unit 1001. The adjustment chart is desirably an image, as indicated in FIG. 4, of gradation patches allowing users to verify from highlight to solid black.

Figure 5:
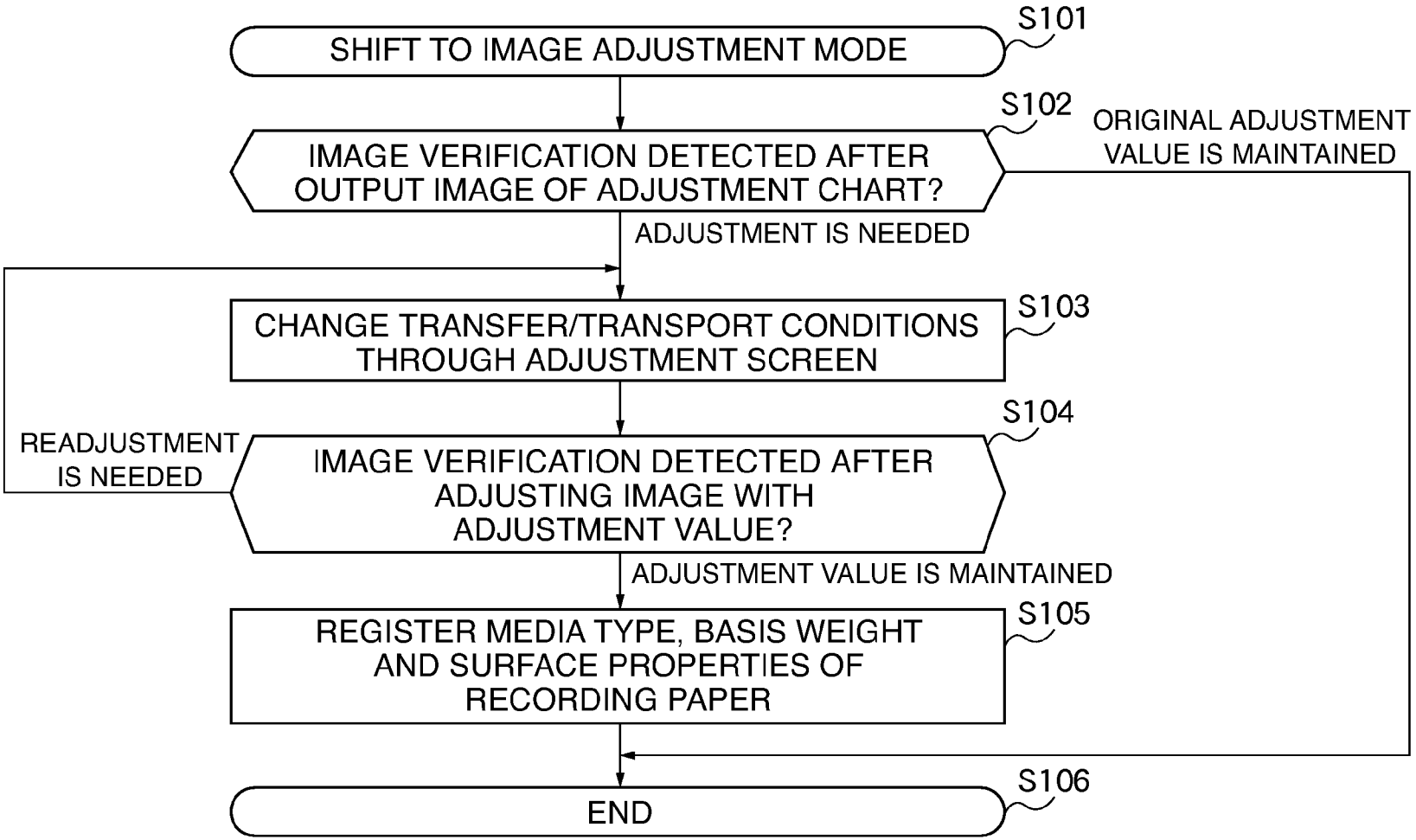
FIG. 5 is a flow chart showing the procedure of an adjustment process for the transfer conditions and transport conditions executed by the image forming apparatus.

FIG. 5 is a flow chart showing the procedure of an adjustment process for the transfer conditions and transport conditions executed by the image forming apparatus 1000.

Figure 6:
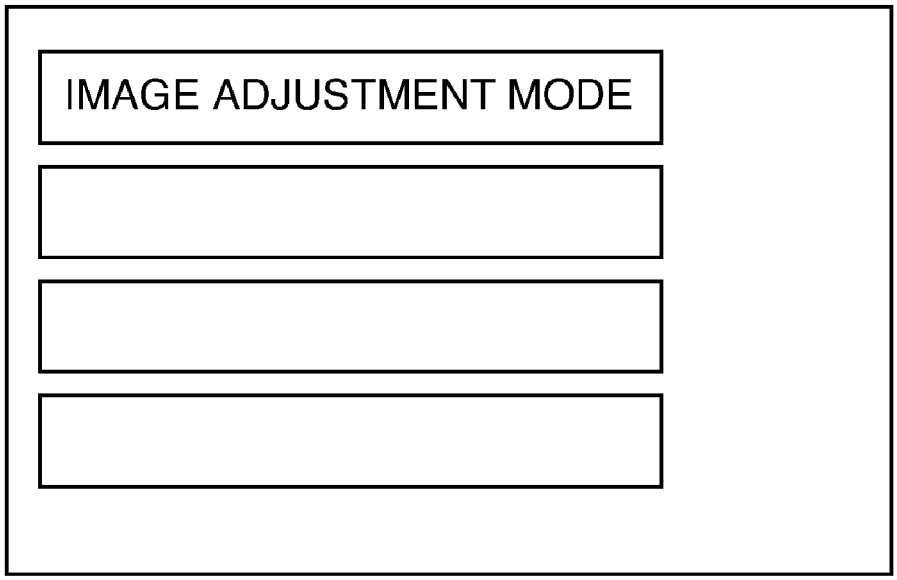
FIG. 6 is a diagram showing an operation screen displaying "image adjustment mode".
Figure 7:
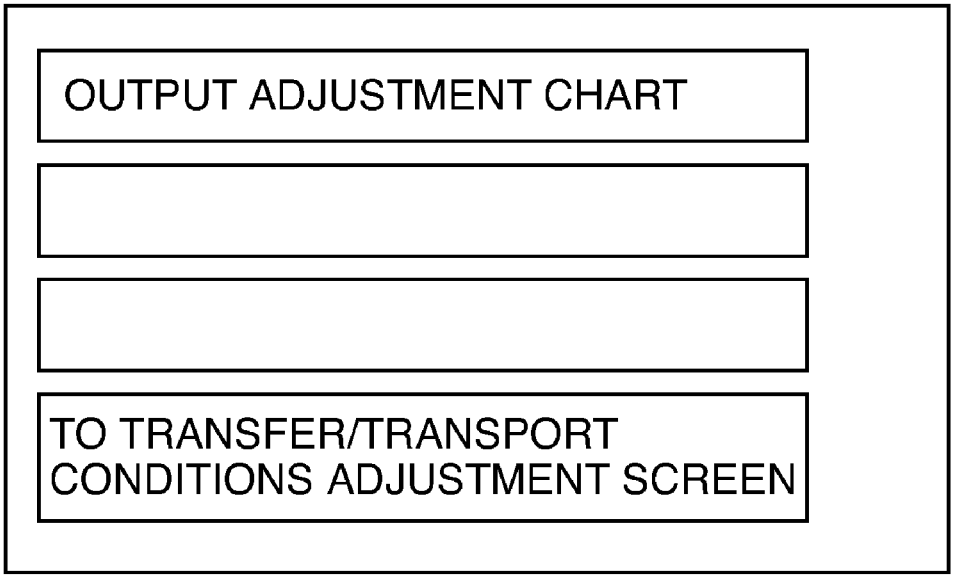
FIG. 7 is a diagram showing the operation screen displaying "output adjustment chart" and "to transfer/transport-condition adjustment screen".

In FIG. 5, the process is executed by a CPU of the controller of image forming apparatus 1000, as will be shown in FIG. 9 later, according to a control program. When a user selects "image adjustment mode" through an operation screen (FIG. 6) displayed on a display of the image forming apparatus 1000, the CPU causes the image forming apparatus 1000 to shift to the image adjustment mode (step S101). When the user next selects "adjustment chart output" (FIG. 7) through the operation screen, the CPU reads out the pattern of the adjustment chart shown in FIG. 4 from the ROM and causes the image forming unit 1001 to output an image of the adjustment chart formed on a recording paper. In this manner, the user verifies the image of the adjustment chart (step S102).

As a result of the image verification, in the case where the user selects "original adjustment value is maintained" in regard to the transfer conditions and transport conditions, the process is terminated (step S106). In the case where the user selects "adjustment is needed" in regard to the transfer conditions and transport conditions as a result of the image verification, more specifically, in the case where the user select "to the adjustment screen for the transfer/transport conditions" through the operation screen (FIG. 7), the CPU shows the adjustment screen for the transfer conditions and transport conditions on the display. In addition, the CPU changes the transfer conditions and transport conditions (step S103) and causes the image forming unit 1001 to output an image of the adjustment chart formed on recording paper. In this manner, the user can verify the image of the adjustment chart (step S104).

Figure 8:
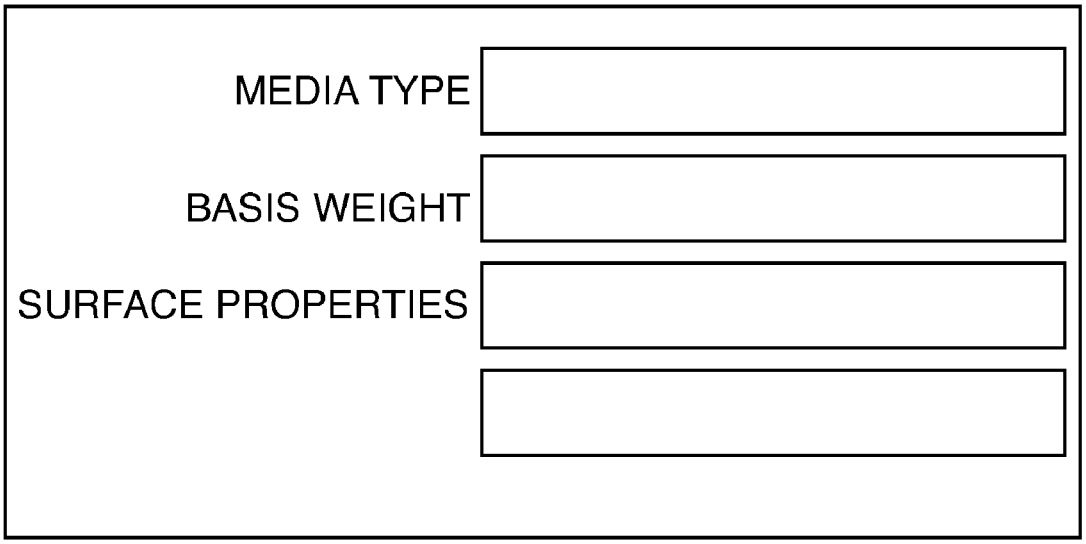
FIG. 8 is a diagram showing a registration screen through which "media type, basis weight and surface properties of the recording paper" are input.

As a result of the image verification, in the case where the user selects "readjustment is required" in regard to the transfer conditions and transport conditions, the process returns to step S103. In the case where the user selects "the adjustment value is maintained" in regard to the transfer conditions and transport conditions as the result of the image verification, that is, in the case where the adjustment value is determined, the CPU shows a registration screen on the display to allow the user to input "media type, basis weight and surface properties of the recording paper" (FIG. 8). After the user inputs the media type, basis weight and surface properties of the recording paper through the registration screen, the CPU stores the input media type, basis weight and surface properties of the recording paper into the RAM (step S105). After this operation, the process is terminated (step S106).

Next time the user uses the image forming apparatus 1000 with recording paper that is the same recording paper used last time to perform image formation, the user executes specified operations through the registration screen. These operations cause the CPU to read out the data (media type, basis weight and surface properties of the recording paper) stored in step S105 from the RAM. In the case where the recording paper is used for the first time in the image forming apparatus 1000, the process returns to step S101.

The above-described control operations allow the user to output the adjustment chart formed on the recording paper to verify it and to adjust the transfer conditions and transport conditions. However, in the control operations, the image needs to be output each time after changing the transfer conditions and transport conditions, and the recording paper used for the adjustment goes to waste. To solve these problems, in preparation for a different kind of recording paper used in the image formation apparatus, the embodiment is configured to obtain a recommended value corresponding to the kind of recording paper as will be described below. This configuration can reduce the number of the recording paper sheets used in the adjustment and the time required for the adjustment.

Specifically, the apparatus-specific data (a transfer voltage or transfer current in the transfer conditions, and a recording-paper transport rate in the transport conditions), which are stored upon the adjustment of the transfer conditions and transport conditions of the image forming apparatus 1000, are associated with the characteristic properties of recording paper and collected by a service center. The service center is a service department of a manufacturer producing the image forming apparatus 1000. When a kind of recording paper is selected by a user through another image forming apparatus and the selected recording paper is the same recording paper selected through the image forming apparatus 1000 in which its data has already been collected, the service center offers the collected data as a recommended value to the user of another image forming apparatus.

The embodiment has the following characteristics.

The data collection/delivery apparatus 95 in the service center collects data, including an adjustment value obtained from the adjustment of the image forming conditions and transport conditions and the characteristic properties (kind (media type), basis weight, surface properties, thickness, stiffness, moisture content, and etc.) of recording paper associated with the adjustment value, from a plurality of the image forming apparatuses, and delivers delivery data to the plurality of the image forming apparatuses through a network. The delivery data will be described now. When characteristic properties of recording paper are input into the image forming apparatus 1000 and the data collection/delivery apparatus 95 holds an adjustment value associated with the input characteristic properties of the recording paper in the collected data, the delivery data means the adjustment value held in the data collection/delivery apparatus 95. Alternatively, in the case where the data collection/delivery apparatus 95 holds a plurality of adjustment values corresponding to the input characteristic properties of the recording paper in its data collected from the plurality of image forming apparatuses, the most frequently stored value among the plurality of adjustment values is offered as a recommended value, which is delivery data.

With the image forming apparatus 1000, a selection of the adjustment value delivered from the data collection/delivery apparatus 95 and an adjustment of the image forming conditions and transport conditions based on the adjustment value can be made. In addition, the image forming apparatus 1000 can compare the reference value preset in the image forming apparatus 1000 and the adjustment value delivered from the data collection/delivery apparatus 95 to change the adjustment value based on the difference between them. The reference value is an optimized adjustment value for recording paper recommended by the manufacturer of the image forming apparatus 1000.

Figure 9:
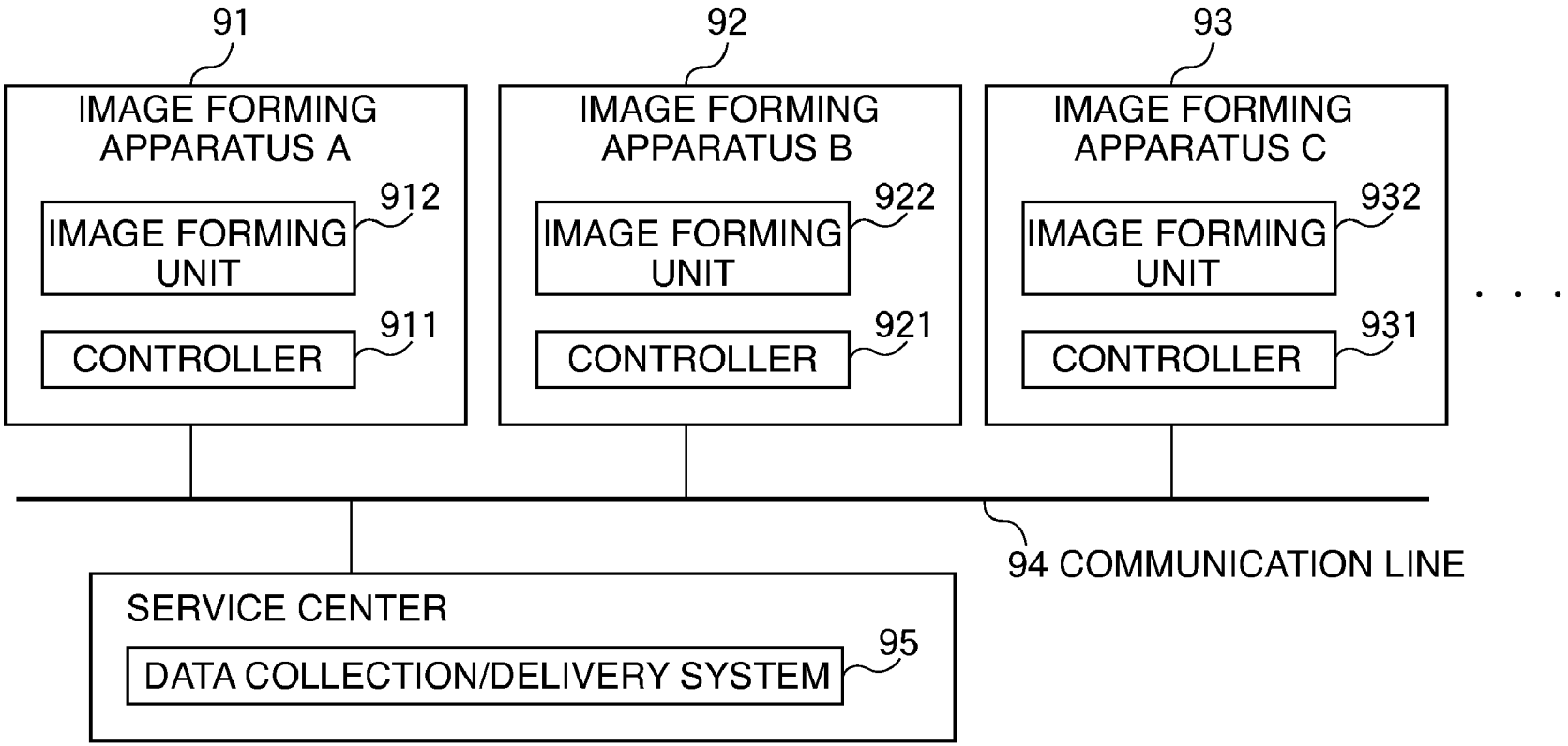
FIG. 9 is a diagram showing a configuration of a market support system including an image forming apparatus installed in a market and a data collection/delivery apparatus in a service center.

FIG. 9 is a diagram showing a configuration of a market support system comprising an image forming apparatus installed in a market and the data collection/delivery apparatus 95 in a service center.

In FIG. 9, an image forming apparatus A91 includes a controller 911 and an image forming unit 912, an image forming apparatus B92 includes a controller 921 and an image forming unit 922, and an image forming apparatus C93 includes a controller 931 and an image forming unit 932. The image forming apparatus A91, image forming apparatus B92 and image forming apparatus C93 are connected to the data collection/delivery apparatus 95 in the service center through a communication line 94. The data collection/delivery apparatus 95 in the service center accesses, through the communication line 94, each controller of the image forming apparatus A91, image forming apparatus B92, image forming apparatus C93 . . . to collect and deliver data.

A concrete example will be provided below. Upon the adjustment of the transfer conditions and transport conditions of recording paper that is used for the first time by the image forming apparatus A91, a user of the image forming apparatus A91, as shown in FIG. 5, inputs data (media type, basis weight and surface properties) of the recording paper to register the data. On the other hand, the data collection/delivery apparatus 95 in the service center accesses the image forming apparatus A91, through the communication line 94, to collect the data registered in the image forming apparatus A91.

Figure 10:
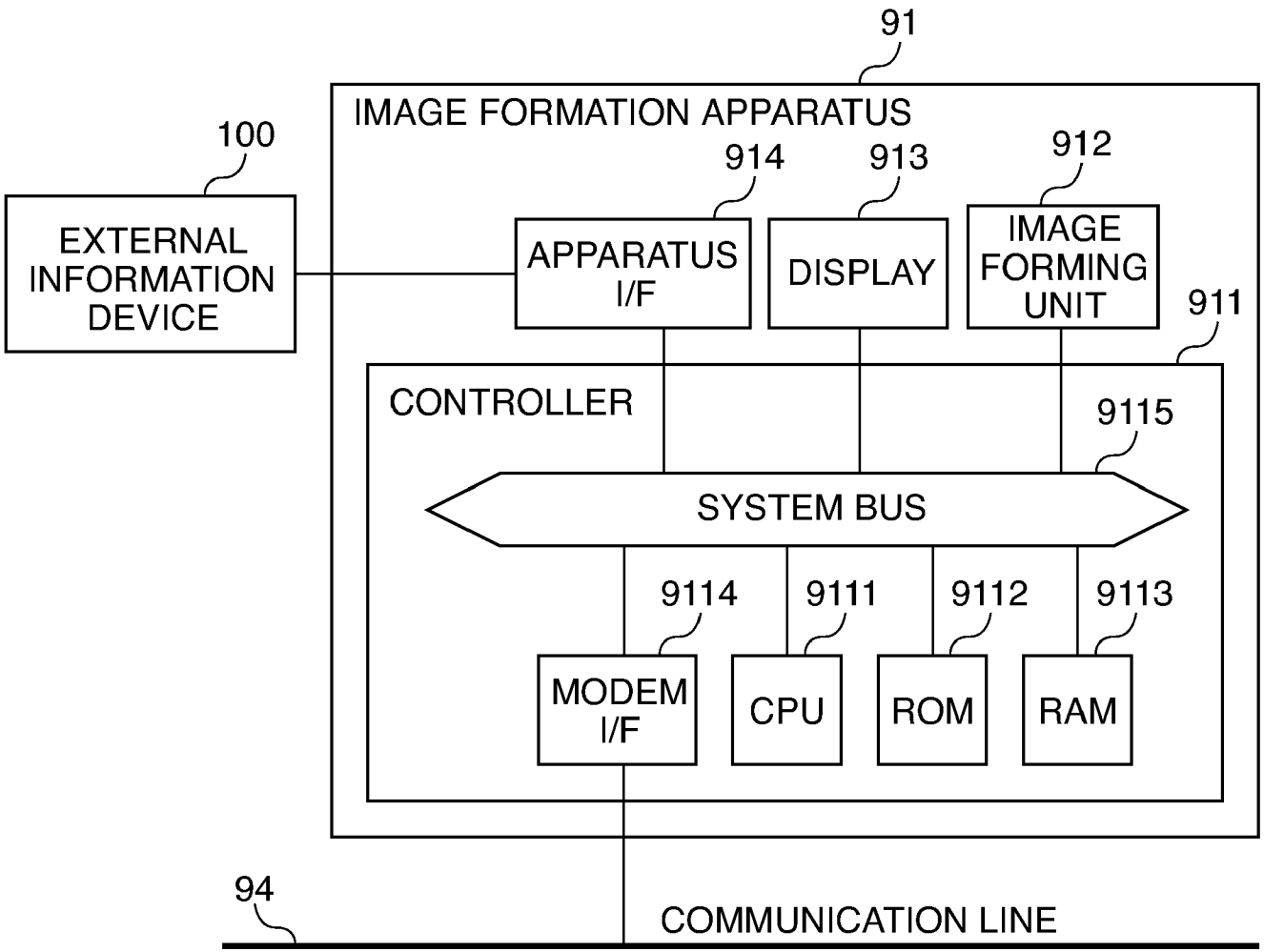
FIG. 10 is a block diagram showing a configuration of a control system and its related parts of the image forming apparatus.

FIG. 10 is a block diagram showing a configuration of a control system and its related parts of the image forming apparatus A91.

Hereinafter, the image forming apparatus B92 and image forming apparatus C93 also have the same configuration as the configuration of the image forming apparatus A91 as in shown in FIG. 10 and therefore their drawings and explanation are omitted. The image forming apparatus A91 comprises a controller 911, an image forming unit 912, a display 913 and an apparatus interface (I/F) 914. The controller 911 comprises a CPU 9111, ROM 9112, RAM 9113, a modem I/F 9114 and a system bus 9115.

The controller 911 is connected through the modem I/F 9114 to the communication line 94, and therefore can acquire or transmit data to the data collection/delivery apparatus 95 in the service center. The display 913 displays an operation screen (FIGS. 6 to 9 and FIGS. 12 to 14). The apparatus I/F 914 connects the image forming apparatus A91 and an external information device 100 to work as an interface with the external information device 100.

The CPU 9111 controls the entire controller, for example, collecting data transmitted from the data collection/delivery apparatus 95 in the service center and data stored in the image forming apparatus A91 to use the data for next image formation operation. In addition, the CPU 9111 controls the image forming unit 912 and display 913 and receives and transmits data from the external information device 100. The ROM 9112 stores the control program executed by the CPU 9111. The RAM 9113 is used as a work area and a data temporary storage area for the CPU 9111. The modem I/F 9114 is connected to the communication line 94.

A concrete example will be provided below. The data collection/delivery apparatus 95 in the service center collects data of the image forming apparatus A91 (transfer voltage or transfer current in the transfer conditions, recording-paper transport rate in the transport conditions). Then, when a user selects the same kind of recording paper as the one used by the image forming apparatus A91 through the image forming apparatus B92 and enters the image adjustment mode, the data collection/delivery apparatus 95 in the service center transmits the data collected from the image forming apparatus A91 as a recommended value to show the data on the display of the image forming apparatus B92. In the case where the user of the image forming apparatus B92 adjusts an image based on the data, the user selects the data, but the user does not need to select the data if the user adjusts the image independently.

Similarly, the data registered in the image forming apparatus B92 after image adjustment (transfer voltage or transfer current in the transfer conditions, recording-paper transport rate in the transport conditions) is transmitted to and accumulated in the data collection/delivery apparatus 95 in the service center. The data collection/delivery apparatus 95 in the service center organizes the enormous volume of data drawn from a market of the plurality of image forming apparatuses, arranges the adjustment values relating to each kind of recording paper in descending order of frequently stored values, and offers from the most frequently stored value as a recommended value. For example, if transfer voltage values are collected as the transfer conditions from the plurality of image forming apparatuses, the plurality of transfer voltage values are arranged in descending order of frequently stored values and offered (delivered) from the most frequently stored value as a recommended value.

Figure 11:
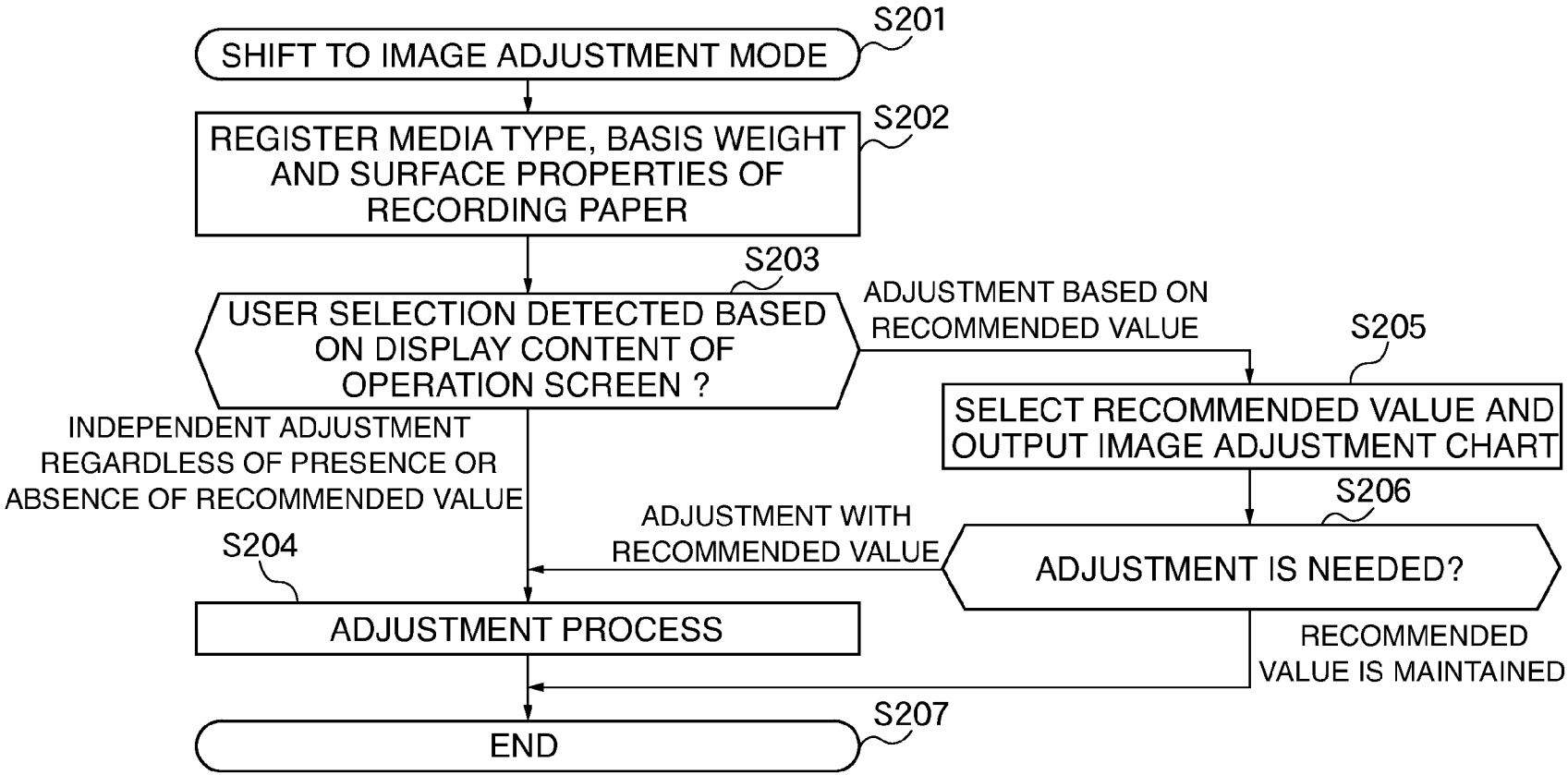
FIG. 11 is a flow chart showing the procedure of an adjustment process for the transfer conditions and transport conditions executed by the image forming apparatus with the use of the market support system.
Figure 12:
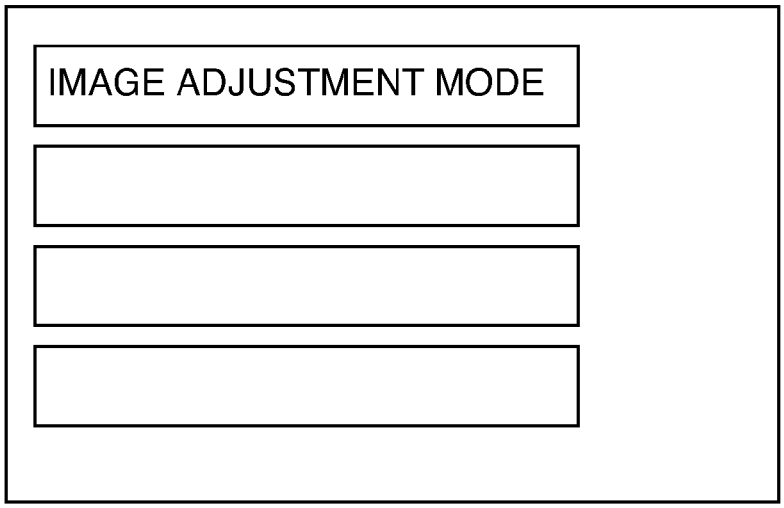
FIG. 12 is a diagram showing the operation screen displaying "image adjustment mode" when the market support system is used.
Figure 13:
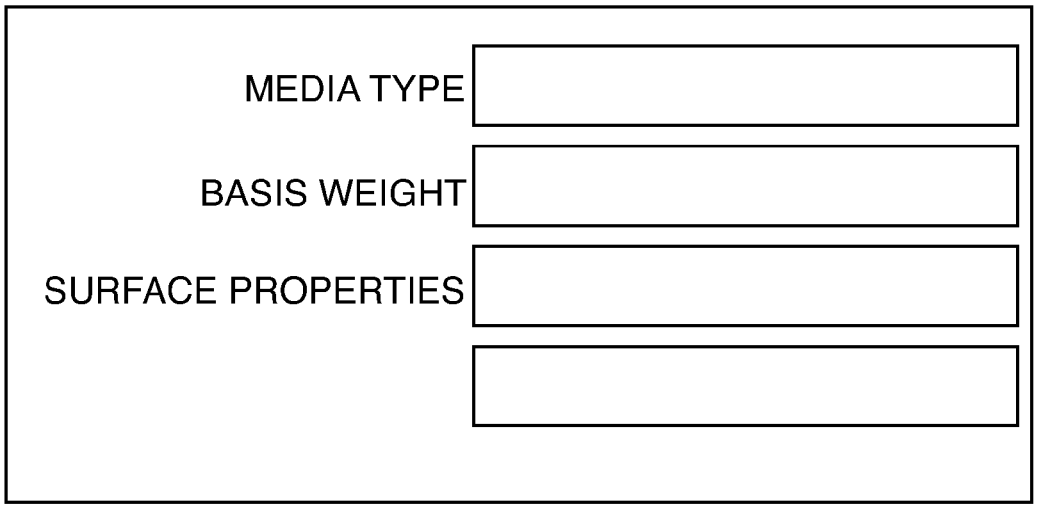
FIG. 13 is a diagram showing the registration screen through which "media type, basis weight and surface properties of the recording paper" are input when the market support system is used.
Figure 14:
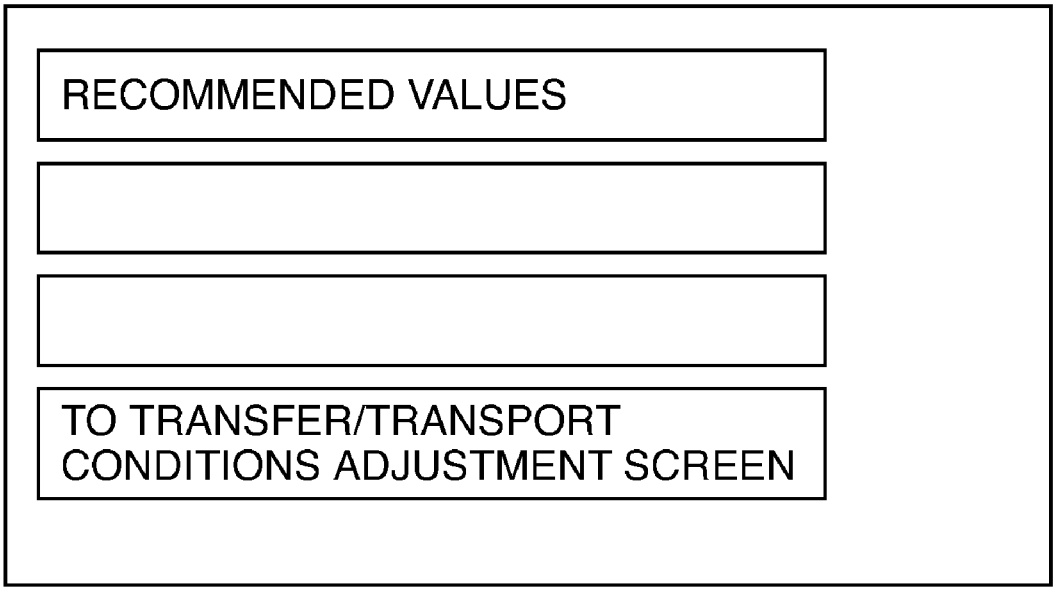
FIG. 14 is a diagram showing the operation screen displaying "recommended value" and "to transfer/transport-condition adjustment screen" when the market support system is used.

FIG. 11 is a flow chart showing the procedure of an adjustment process for the transfer conditions and transport conditions executed by the image forming apparatus A91 with the market support system.

In FIG. 11 the process is executed by the CPU of the controller 911 of the image forming apparatus A91 according to the control program. When a user selects "image adjustment mode" through an operation screen (FIG. 12) displayed on a display of the image forming apparatus A91, the CPU causes the image forming apparatus A91 to shift to the image adjustment mode (step S201). After the user inputs the media type, basis weight and surface properties of the recording paper through a registration screen (FIG. 13) of the image forming apparatus A91, the CPU stores the input media type, basis weight and surface properties of the recording paper into the RAM (step S202).

In the case where data, including an adjustment value obtained from the adjustment of the transfer conditions and transport conditions and the characteristic properties of the recording paper associated with the adjustment value, is stored in the data collection/delivery apparatus 95 in the service center, the data collection/delivery apparatus 95 transmits the data of a recommended value to the image forming apparatus A91. In this manner, the "recommended value" is displayed on the operation screen (FIG. 14) of the image forming apparatus A91. If the user selects "independent adjustment regardless of presence or absence of the recommended value" based on display content of the operation screen (NO to step S203), the adjustment process proceeds from step S102 to S105 shown in the flow chart of FIG. 5 (step S204). If the user selects "adjustment based on recommended value" based on display content of the operation screen (YES to step S203), the CPU causes the image forming unit 912 to output an adjustment chart formed on recording paper (step S205). In this manner, the user can verify the image of the adjustment chart (step S206).

As a result of the image verification, in the case where the user selects "adjustment with the recommended value", the process proceed to step S204. In the case where the user selects "recommended value is maintained" as a result of the image verification, more specifically in the case where the user recognizes that the image of the adjustment chart formed on the recording paper has no problem, the process is terminated (step S207).

Even if the recommended value is ready as described above, readjustment is possibly required; however, the presence of the recommended value reduces the number of adjustments in comparison with the case of the absence of the recommended value, since the user can determine whether adjustment is needed based on the recommended value.

As described above, according to the embodiment, the image forming apparatus A91 adjusts the image forming conditions and the transport conditions of the recording material according to the characteristic properties of the recording paper, and transmits data including an adjustment value associated with the characteristic properties of the recording paper to the data collection/delivery apparatus 95 in the service center. The data collection/delivery apparatus 95 collects the data from a plurality of image forming apparatuses and delivers the data through a network. In the case where the characteristic properties of the recording paper are input into the image forming apparatus A91 and the data collection/delivery apparatus 95 holds the adjustment value associated with the characteristic properties of the recording paper in the collected data, the data collection/delivery apparatus 95 delivers the adjustment value to the image forming apparatus A91. In the case where the data collection/delivery apparatus 95 holds a plurality of adjustment values associated with the characteristic properties of the recording paper in the data collected from a plurality of image forming apparatuses, the data collection/delivery apparatus 95 offers the most frequently stored adjustment value from the plurality of adjustment values as a recommended value.

In this manner, reduction of time required to adjust the image forming conditions (transfer conditions, fixing conditions) and transport conditions can be made and the number of the recording paper sheets used for the adjustment can be minimized. Especially, the image forming apparatus according to the present invention can retrieve recommended values for recording paper of kinds that have not been used yet and require adjustment of the transfer conditions and transport conditions. Furthermore, if the transfer conditions and transport conditions can be changed by referring to the recommended value, the adjustment can be made with a minimum change of the conditions, thereby reducing the number of wasted recording paper sheets to a minimum.

Although in the above-described embodiment, an image forming apparatus performing electrophotographic image formation is used, the present invention is not limited thereto. The present invention may be applied to an image forming apparatus performing electrostatic image formation.

Although the transfer conditions are described as an example of the image forming conditions in the above embodiment, the present invention is not limited thereto. The present invention may be applied to fixing conditions as the image forming conditions.

Although in the above embodiment, the system is described, as an example, in which the service center collects data including an adjustment value obtained from the adjustment of the image forming conditions and transport conditions and the characteristic properties of the recording paper associated with the adjustment value from image forming apparatuses through a communication line, and the adjustment value is delivered to the image forming apparatuses as a recommended value, the present invention is not limited thereto. In order to further eliminate steps of adjustment, the recommended value of the image forming conditions and transport conditions can be adjusted in consideration of the variations among the image forming apparatuses.

Furthermore, although the system is described, as an example, in which the service center collects data from image forming apparatuses and delivers the data as a recommended value in the above embodiment, the present invention is not limited thereto. The recommended value for the image forming conditions and transport conditions can be offered after correcting the recommended value as follows.

In the case where the image forming apparatuses are individually different from each other, there may be discrepancies in the recommended values of the image forming conditions and transport conditions. The individual differences in the image forming apparatuses are possibly caused by variations of the diameter of the secondary transfer unit and the pair of resist rollers, the usage environment of the image forming apparatuses, the number of used recording paper sheets and other factors. For these factors, the service center is adapted to compare the difference in measured resistance values of the secondary transfer units just before use and the difference in adjustment results of recording paper sheets of the same kind, thereby correcting the recommended value. In this manner, the individual differences in the image forming apparatuses can be reduced as much as possible, and therefore a highly-accurate recommended value for the image forming conditions and transport conditions can be provided to users.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Example of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program code may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2007-79219 filed Mar. 26, 2007, which is hereby incorporated by reference herein in its entirety.

What is claimed is:

1. An image forming apparatus configured to transfer an image formed on an image carrier onto a transported recording material to perform image formation and adapted to communicate with a data collection/delivery apparatus, comprising:

an adjustment unit adapted to adjust image forming conditions and transport conditions for the recording material according to the characteristic properties of the recording material;

a generation unit adapted to generate associated data including an adjustment value obtained from the adjustment of the image forming conditions and transport conditions made by said adjustment unit and the characteristic properties of the recording material associated with the adjustment value;

a storage unit adapted to store said associated data; and a control unit adapted to transmit the associated data stored in said storage unit to said data collection/delivery apparatus and receive delivery data regarding the adjustment of the image forming conditions and transport conditions from said data collection/delivery apparatus.

2. The image forming apparatus according to claim 1, wherein the characteristic properties of said recording material are at least any one selected from a group consisting of a kind of recording material, basis weight of the recording material, surface properties indicating the degree of smoothness/roughness of the recording material, thickness of the recording material, stiffness of the recording material and moisture content of the recording material.

3. The image forming apparatus according to claim 1, wherein said image forming conditions are at least any one selected from a group consisting of transfer conditions and fixing conditions.

4. The image forming apparatus according to claim 3, wherein said transfer conditions are at least any one selected from a group consisting of a transfer voltage and transfer current.

5. The image forming apparatus according to claim 3, wherein said fixing conditions are at least any one selected from a group consisting of a fixing pressure, fixing temperature and fixing rate.

6. The image forming apparatus according to claim 1, wherein said transport conditions are at least any one selected from a group including a transport rate at which the recording material is transported to a transfer position.

7. The image forming apparatus according to claim 1, further comprising a readjustment unit adapted to readjust the image forming conditions and transport conditions based on a verification result of an image formed on a recording material after the adjustment of the image forming conditions and transport conditions made by said adjustment unit.

8. A market support system comprising said image forming apparatus and said data collection/delivery apparatus according to claim 1, said image forming apparatus and data collection/delivery apparatus being connected through a network to communicate with each other, wherein said data collection/delivery apparatus is connected to other image forming apparatuses including said adjustment unit, said generation unit, said storage unit and said control unit through the network to communicate with each other, and said data collection/delivery apparatus includes a collection unit adapted to collect said associated data from said image forming apparatus and said other image forming apparatuses and a delivery unit adapted to deliver said delivery data through said network to said image forming apparatus and said other image forming apparatuses.

9. The market support system according to claim 8, wherein said image forming apparatus and other image forming apparatuses further comprises an input/transmission unit adapted to input the characteristic properties of a recording material and transmit the characteristic properties of the recording material to said data collection/delivery apparatus, and when said data collection/delivery apparatus holds an adjustment value, associated with the characteristic properties of the recording material and input and transmitted by either one of said image forming apparatus and other image forming apparatuses, in said collected associated data, said data collection/delivery apparatus delivers the adjustment value as said delivery data to said image forming apparatus.

10. The market support system according to claim 8, wherein when said data collection/delivery apparatus holds a plurality of adjustment values, associated with the characteristic properties of the recording material and input and transmitted by said image forming apparatus and other image forming apparatuses, in said collected associated data, said data collection/delivery apparatus delivers the most frequently stored value from the plurality of adjustment values as said delivery data to said image forming apparatus.

11. The market support system according to claim 8, wherein when an adjustment value is delivered as said delivery data from said data collection/delivery apparatus, said adjustment unit adjusts the image forming conditions and transport conditions based on said delivered adjustment value.

12. The market support system according to claim 8, wherein said image forming apparatus previously holds a reference value, and said adjustment unit changes the adjustment value used to adjust the image forming conditions and transport conditions based on the difference between the adjustment value delivered from said data collection/delivery apparatus and said reference value.

13. A control method of an image forming apparatus configured to transfer an image formed on an image carrier onto a transported recording material to perform image formation and adapted to communicate with a data collection/delivery apparatus, the method comprising steps of:

adjusting image forming conditions and transport conditions for the recording material according to the characteristic properties of the recording material;

generating associated data including an adjustment value obtained through said adjusting step of adjusting the image forming conditions and transport conditions and the characteristic properties of the recording material associated with the adjustment value;

storing said associated data in a storage unit; and transmitting the associated data stored in said storage step to said data collection/delivery apparatus and receiving delivery data regarding the adjustment of the image forming conditions and transport conditions from said data collection/delivery apparatus.

14. A non-transitory computer-readable storage medium including a program that, when executed by a computer, causes the computer to execute a control method of an image forming apparatus configured to transfer an image formed on an image carrier onto a transported recording material to perform image formation and adapted to communicate with a data collection/delivery apparatus, wherein said control method comprises the steps of:

adjusting image forming conditions and transport conditions for the recording material according to the characteristic properties of the recording material;

generating associated data including an adjustment value obtained through said adjusting step of adjusting the image forming conditions and transport conditions and the characteristic properties of the recording material associated with the adjustment value;

storing said associated data in a storage unit; and transmitting the associated data stored in said storage step to said data collection/delivery apparatus and receiving delivery data regarding the adjustment of the image forming conditions and transport conditions from said data collection/delivery apparatus.

* * * * *